United States Patent [19]

Day et al.

[11] Patent Number: 4,519,568

[45] Date of Patent: May 28, 1985

[54] APPARATUS FOR CONSTRUCTING MODULAR PRE-CAST CONCRETE BUILDINGS

[76] Inventors: James D. Day; James D. Day, II, both of 5001 S. Claiborne, New Orleans, La. 70125

[21] Appl. No.: 499,650

[22] Filed: May 31, 1983

[51] Int. Cl.[3] ..... B28B 7/10

[52] U.S. Cl. ..... 249/66 R; 249/144; 249/152; 249/156

[58] Field of Search ..... 249/66, 142, 144, 152, 249/159, 160, 170, 178, 256

[56] References Cited

U.S. PATENT DOCUMENTS

| | | | |
|---|---|---|---|
| 2,948,044 | 8/1960 | Dawson | 249/66 |
| 3,260,494 | 7/1966 | Deigard | 249/63 |
| 3,539,146 | 11/1970 | Smith | 249/66 |
| 3,867,503 | 2/1975 | Shoe | 249/66 |
| 4,243,198 | 1/1981 | Beretta | 249/66 |

*Primary Examiner*—John A. Parrish
*Attorney, Agent, or Firm*—Bode & Smith

[57] ABSTRACT

An apparatus for constructing a unitary pre-cast concrete modular building unit comprising: a collapsible outer form having a rigid rectangular base and rigid walls pivotally connected thereto and collapsible to the plane of said base; a hydraulically retractable inner form thus providing with the outer form, a mold for said building unit; and an extruder for removing said inner form from said building unit.

18 Claims, 14 Drawing Figures

APPARATUS FOR CONSTRUCTING MODULAR PRE-CAST CONCRETE BUILDINGS

BACKGROUND OF THE INVENTION

1. Field of the Invention

The present invention relates to modular building units and an apparatus and method for constructing such modular building units. Even more particularly, the present invention relates to unitary pre-cast concrete modular building units and an apparatus and method for constructing such unitary pre-cast concrete modular building units.

2. General Background

Various buildings, and apparatus and methods which relate to constructing prefabricated and modular building units are known.

One such type of portable prefabricated building is that which is constructed with "knock down" sections to be united into a single structure. Such type of building is provided for in the following U.S. Patents:

U.S. Pat. No. 3,566,554 issued to M. B. Schaffer et al. entitled "Prefabricated Building";

U.S. Pat. No. 2,247,893 issued to A. E. Sieber entitled "Portable Diner";

U.S. Pat. No. 3,890,747 issued to C. Van Der Lely entitled "Prefabricated Space-Bounding Building Sections and a Building Made From Said Sections"; and U.S. Pat. Nos. 2,089,058 and 2,089,059 issued to B. G. Harley entitled "Diner".

A method for manufacturing prefabricated housing units providing for detachable prefabricated panels and pouring concrete slabs to unite the slabs and panels is shown in U.S. Pat. No. 3,834,110 issued to M. Vercelletto.

These devices fail in that they do not provide for a unitary pre-cast concrete building unit. These devices further fail in that the buildings need be erected or knocked down for shipment to or from the erection site.

The pre-cast concrete module as shown in the June 1981 article first appearing in "Concrete Products", is manufactured by Master Module Homes, Inc. and discloses a manufacturing process involving the use of multiple casting beds (or floor slabs) and wheeled wagon form sets, each set having sections which must be joined together to form the walls and roof. This device fails in that separate casting beds and movable forms must be used together to form walls and a roof. Also, shore jacks must be used as the forms are removed or freed ad seriatim to insure proper curing. The "Master Module Home" is plant constructed, transported to the site, assembled, adjusted and fitted-out; all unnecessary with the apparatus of the present invention.

GENERAL DISCUSSION OF THE PRESENT INVENTION

The present invention provides an apparatus for constructing a unitary pre-cast concrete modular building unit comprising a collapsible outer form and a retractable inner form thus providing a mold for said unit, and a means for extruding the inner form from the mold thereby leaving the building unit free standing.

The outer form further comprises a rigid rectangular base and rectangular side walls and an end wall pivotally connected to the base and collapsible to the plane of said base.

The inner form is comprised of a plurality of rigid walls mounted on a rigid core support member thereby forming with the outer form a mold for said building unit. The walls of the inner form are hydraulically retractable from the mold-forming or extended position to allow extrusion of the inner form from the mold.

It is an object of the present invention to provide an apparatus for manufacture of a unitary pre-cast concrete modular building unit.

It is a further object of the present invention to provide an apparatus for the manufacture of a unitary pre-cast concrete building unit having outer collapsible and inner retractable forms providing a mold for said concrete unit.

It is still a further object of the present invention to provide pivot means for collapsing said outer form.

It is a further object of the present invention to provide hydraulic means for retracting said inner form.

It is a further object of the present invention to provide means for extruding the retractable inner form from the mold after casting to provide a free standing unit.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
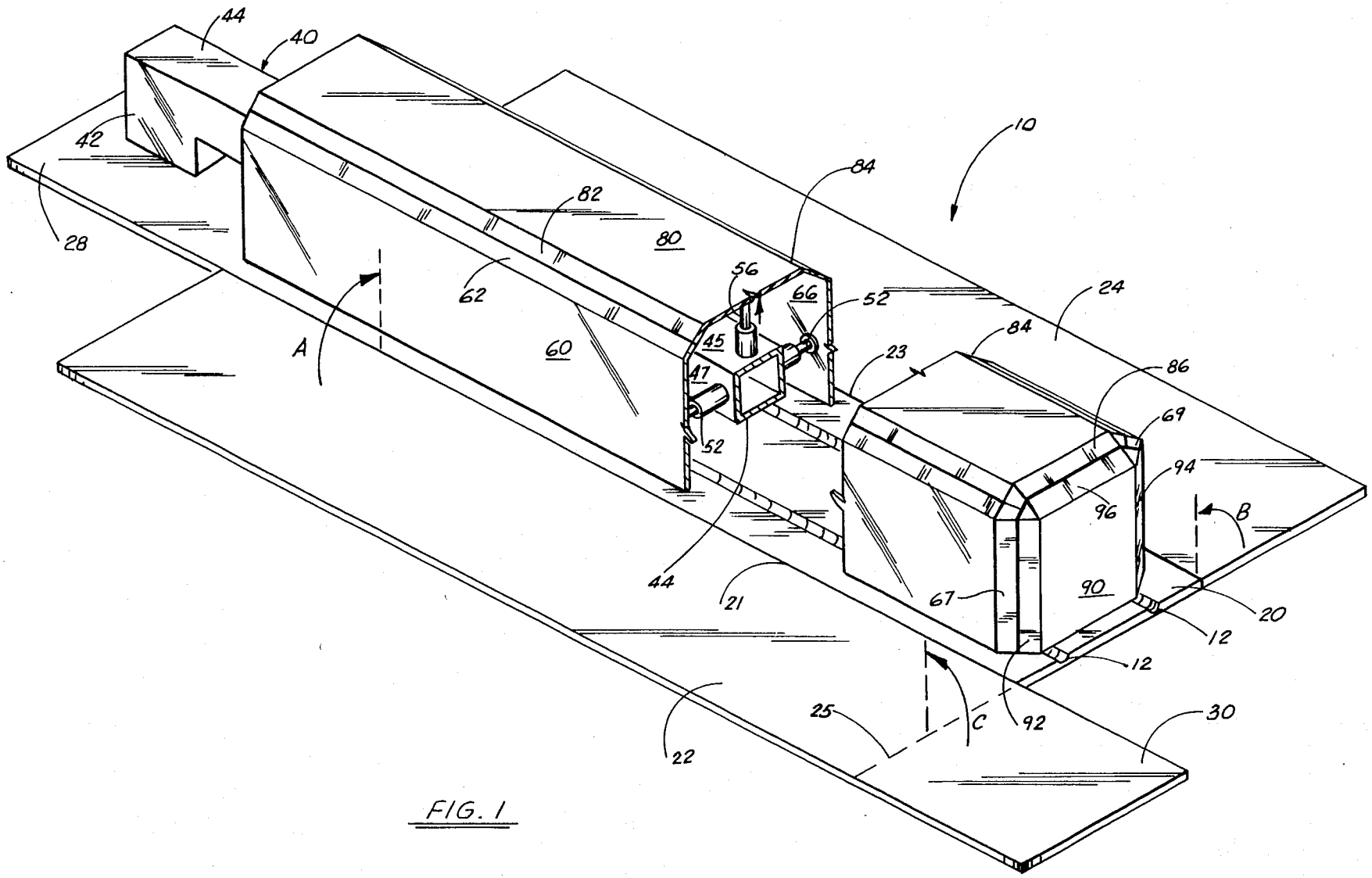
FIG. 1 is a perspective cut-away view of the apparatus of the present invention illustrating the collapsed position of the outer form and the extended position of the inner form.

FIG. 1 best shows the preferred embodiment of the apparatus of the present invention designated generally by the numeral 10. Apparatus 10 provides an elongated rigid rectangular base 20 which can be supported off of the ground by a plurality of conventional support beams or the like (not shown). Hingedly or pivotally attached to rectangular base 20 along its parallel edges 21, 23 are ridged rectangular exterior side walls 22, 24. As best seen in FIG. 1, side walls 22, 24 are of slightly reduced length as compared to rectangular base 20 to provide for extended portion 28 of base 20. Pivotally or hingedly attached to either of the side walls 22, 24 (for illustration purposes side wall 22 of FIG. 1) along its edge (edge 25 of wall 22) is rectangular end wall 30.

Figure 2:
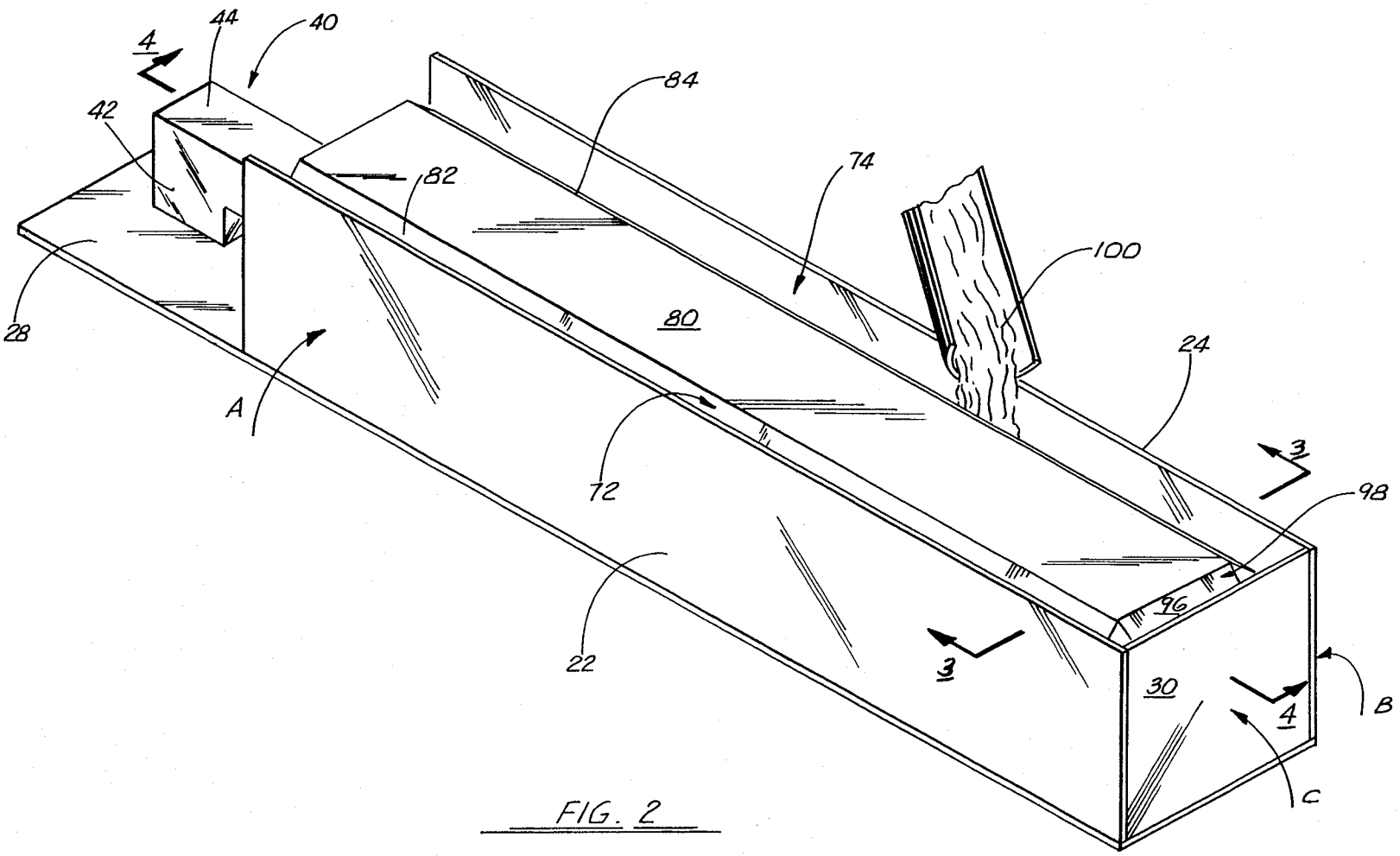
FIG. 2 is a perspective view of the apparatus of the present invention illustrating the mold formed by the outer form in the assembled position and the inner form in the extended position.
Figure 3:
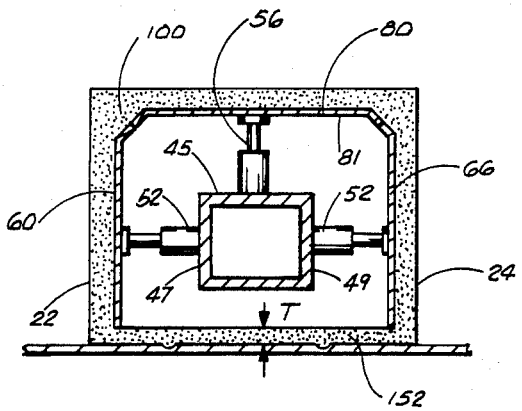
FIG. 3 is a sectional end view of the apparatus of FIG. 2 taken along the line 3—3 of FIG. 2 and after concrete has been poured.

As seen in FIGS. 1 and 2, side walls 22, 24 can be rotated in the direction of ARROWS A and B respectively from the first position of being in the same plane (longitudinal) as rectangular base 20 (FIG. 1) to the second position of extending vertically from or perpendicular to base 20 (FIG. 2). Similarly, end wall 30 is rotatable or pivotally moveable in the direction of ARROW C from a position in the same plane (longitudinal) of rectangular base 20 and side walls 22, 24 in the first position (FIG. 1) to a position extending vertically from or perpendicular to rectangular base 20 and transversely disposed or perpendicular to side walls 22, 24 in the second position (FIG. 2). Thus the pivotable interconnection of base plate 20, side walls 22, 24 and end wall 30 allows for the assembled open-ended box-like structure of apparatus 10 best illustrated in FIG. 2.

As best seen in FIG. 1, mounted on base 20 and integral therewith is extruder 40 comprised of vertical neck portion 42 extending vertically from base 20 at extended portion 28. Integral with vertical neck portion 42 and extending perpendicular thereto (and thus parallel to base 20) substantially longitudinally of base 20 is elongated core 44. Thus in the assembled condition, best shown in FIGS. 2 and 12, core 44 extends longitudinally about the center line of apparatus 10.

Figure 4:
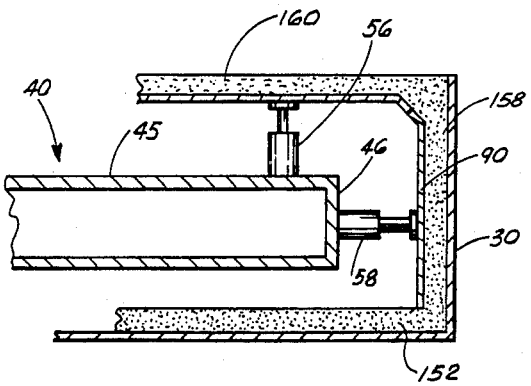
FIG. 4 is a partial sectional side view of the apparatus of FIG. 2 taken along the line 4—4 of FIG. 2 and after concrete has been poured.
Figure 5:
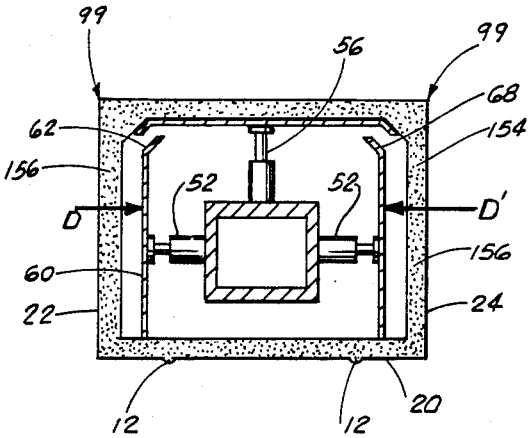
FIG. 5 is a sectional end view of the apparatus of FIG. 2 taken along line 3—3 of FIG. 2, but with the side walls of the inner form in the retracted position and after concrete has been poured.
Figure 6:
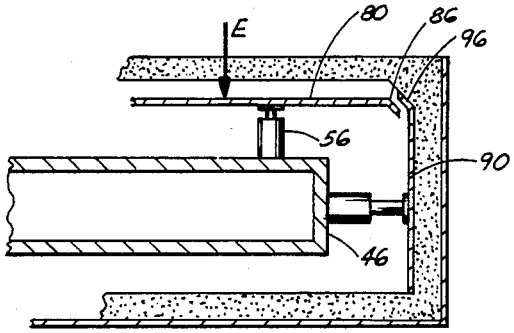
FIG. 6 is a partial sectional view of the apparatus of FIG. 2 taken along line 4—4 of FIG. 2, but with the upper walls and side walls of the inner form in the retracted position and after concrete has been poured.
Figure 7:
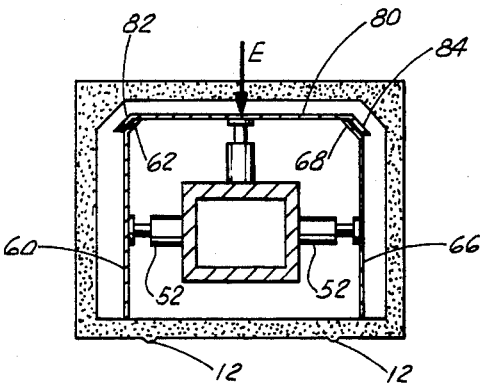
FIG. 7 is a sectional end view of the apparatus of FIG. 2 taken along line 3—3 of FIG. 2, but with the side walls and the upper wall of the inner form in the retracted position.
Figure 8:
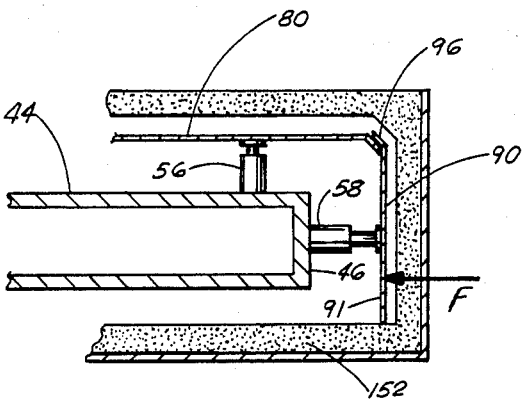
FIG. 8 is a partial sectional view of the apparatus of FIG. 2 taken along the line 4—4 of FIG. 2, but with the side walls (not shown), the upper wall and the end wall of the inner form in the retracted position and thus the inner form in a totally retracted position.

Elongated core 44 is of the cross-sectional rectangular shape illustrated in FIGS. 1 and 3–8, and thus provides upper horizontal surface 45 substantially parallel to base 20 and vertical surfaces 47, 49 which are substantially parallel to side walls 22, 24 when side walls 22, 24 are provided in the vertical or assembled position of FIGS. 2–8 and 12. Further, as best seen in FIGS. 4, 6 and 8, core 44 provides end surface 46 substantially parallel to end wall 30 in the assembled position.

Figure 12:
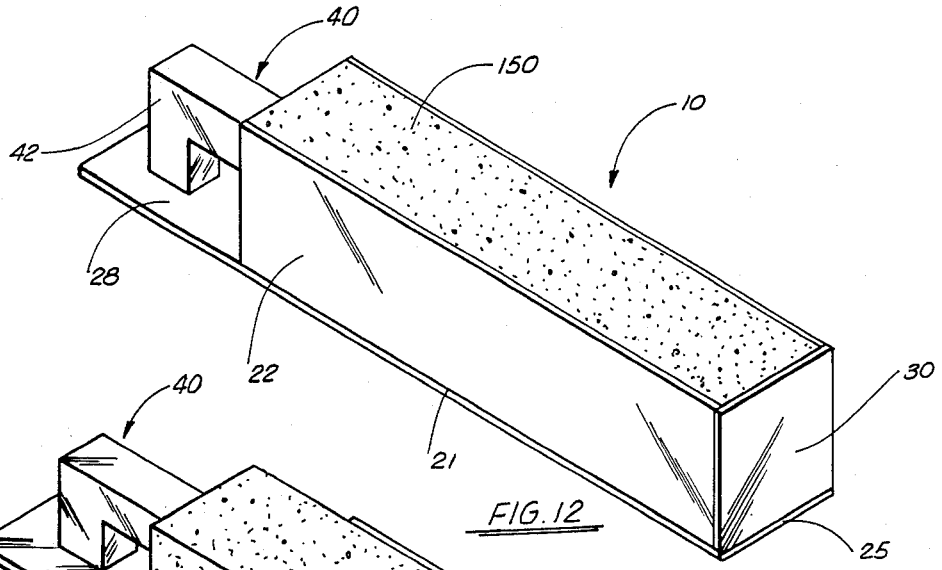
FIG. 12 is a perspective view of the apparatus of the present invention illustrated in the assembled position of the outer form and extended position of the inner form and concrete formed in the mold created therebetween.
Figure 13:
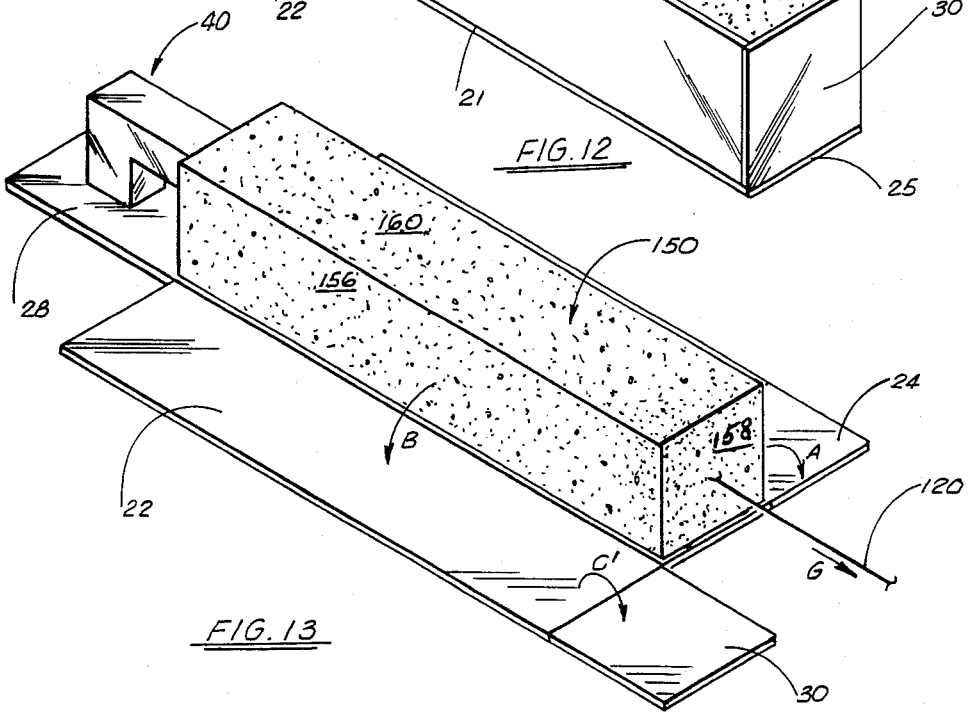
FIG. 13 is a view of FIG. 12 with the outer form in a collapsed position and the hardened mold anchored.
Figure 14:
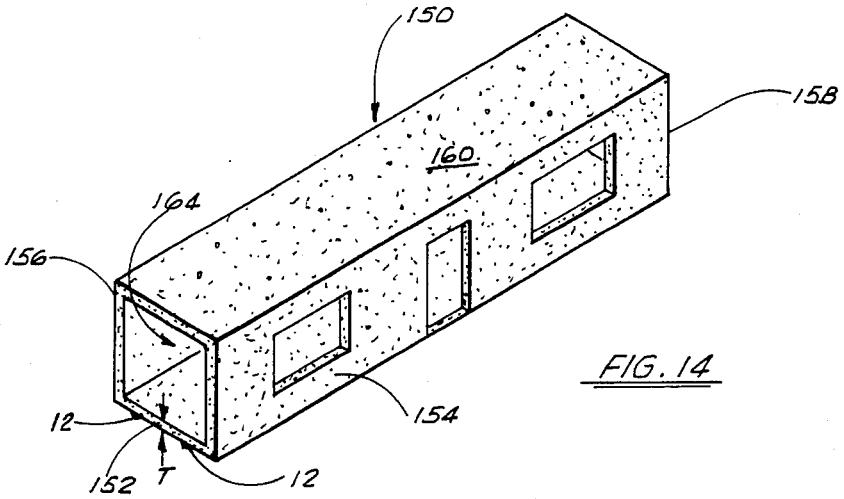
FIG. 14 is a perspective view of a pre-cast concrete building unit as constructed by the apparatus and method of the present invention.

Fixedly attached to each of vertical surfaces 47, 49 are a plurality of horizontally mounted hydraulically operated arms 52 which support at their opposite ends rigid interior vertical side walls 60, 66 respectively, generally parallel to vertical surfaces 47, 49 and thus also generally parallel to exterior side walls 22, 24 when provided in the vertical or assembled position of FIGS. 2 and 12. In the preferred embodiment hydraulically operated arms 52 will be provided in sets or pairs connecting surface 47 to wall 60 and surface 49 to wall 66, with the number of sets or pairs of hydraulic arms 52 connecting surfaces 47, 49 and walls 60, 66 depending on the length of apparatus 10 such additional arms 52 being provided spaced therethrough; however, for illustrative purposes only, only one (1) of such hydraulic arm sets is shown in FIG. 1. Fixedly attached to upper horizontal surface 45 are a plurality of vertically mounted hydraulically operated arms 56 which support at their opposite ends rigid upper wall 80 generally parallel to base 20. The number of arms 56 will also depend on the length of apparatus 10 with only one (1) illustrated. In the preferred embodiment, as best seen in FIGS. 4, 6 and 8, fixedly attached to end surface 46 of core 44 is longitudinally mounted, hydraulically operated arm 58 which supports at its opposite end rigid interior end wall 90 generally parallel to end surface 46 and thus also generally parallel to exterior end wall 30 when positioned in the vertical or assembled position. In the preferred embodiment only one (1) hydraulic arm 58 is illustrated; however, additional hydraulic arms can be provided if necessary for strength, static and dynamic balance, etc. Thus, in the preferred embodiment the number of hydraulic arms 52, 56 will depend on the length of apparatus 10 and the number of arms 58 will depend on the characteristics of the building unit to be constructed. The number of each of arms 52, 56, 58 shown in the FIGURES are thus for illustrative purposes only.

Interior side walls 60, 66 are provided with integral upper flange portions 62, 68 respectively and end flange portion 67, 69 respectively which depend laterally therefrom at an angle of approximately 45° from the vertical but terminate below the bottom surface 81 of upper wall 80 and the inner surface 91 of end wall 90. Similarly, upper wall 80 is provided with side flange portions 82, 84 and end flange portion 86 which depend laterally therefrom at an angle of approximately 45° to the horizontal. End flange portion 86 terminates short of the inner surface 91 of end wall 90, as best seen in FIGS. 4, 6 and 8. Similarly, interior end wall 90 is provided with side flange portions 92, 94 and upper flange portion 96 depending laterally therefrom at an angle of approximately 45°, as seen in FIGS. 1, 4, 6, 8, and 9–11.

In operation apparatus 10 is assembled from the collapsed position of FIG. 1 into the open-ended box-like structure of FIGS. 2 and 12 by first positioning side walls 22, 24 and end wall 30 to the vertical position relative to base 20 by rotation in the directions of ARROWS A, B, and C respectively. Then hydraulic arms 58, 56, 52 are extended to their maximum limit sequentially in that order so that: interior side walls 60, 66 are more proximate and substantially parallel to walls 22, 24 respectively thereby creating voids 72, 74 therebetween; upper wall 80 is substantially parallel to base 20; and, interior end wall 90 is more proximate outer end wall 30 thus creating void 98 therebetween. This arrangement, best illustrated in FIG. 2, provides for flange portions 62, 64 and 82, 84 to be generally overlapping with flange portions 82, 84 overlapping flange portions 62, 64, thus mating upper wall 80 with side walls 60, 66 from which they now respectively depend; and, flange portions 92, 94 generally overlapping end flanges 67, 69 thus mating interior end wall 90 with side walls 62, 64 from which they respectively depend. Similarly flange portion 96 generally overlaps flange portion 86 thus mating interior end wall 90, upper wall 80 and side walls 62, 66 which themselves are mated with end wall 90.

With this sequencing, all interior walls 60, 66, 80, 90 are moved more proximate exterior walls 22, 24, and 30 and apparatus 10 is assembled thereby forming a mold within which to pour concrete 100 to form pre-cast building unit 150 with base 20, exterior side walls 22, 24 and exterior end wall 30 providing the outer form of the mold, and inner walls 60, 66, upper wall 80 and interior end wall 90 forming the inner form of the mold.

As illustrated in FIG. 2, concrete 100 is now poured into voids 72, 74 and 98 and by its inherent fluid flow will first settle above rectangular base 20 to provide the base or slab 152 for pre-cast building 150. The quantum of concrete should be sufficient to provide slab 152 with a thickness T, terminating at a height just below the lower most point of interior walls 60, 66 and 90. Once slab 152 has been allowed to cure for approximately 24 hours, a second quantum of concrete is poured to fill voids 72, 74 and 98 thus providing side walls 154. 156 and end wall 158 of pre-cast building unit 150. After walls 154, 156, 158 have been allowed to cure approximately 24 hours, a third quantum of concrete is poured so as to cover interior upper wall 80 and raise the concrete to a level substantially equal to the upper most point 99 of side walls 22, 24 and horizontally level therewith to provide roof 160 for pre-cast building unit 150.

Once the entire pre-cast building unit 150 has been allowed to cure approximately 48 hours beyond the third such pouring of concrete, unit 150 is sufficiently solidified to allow removal of apparatus 10.

Figure 9:
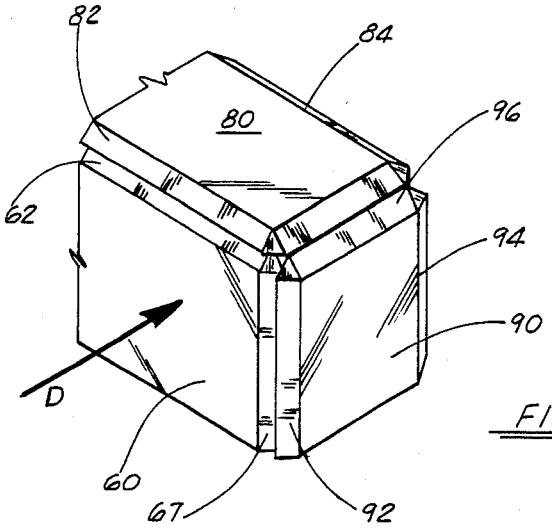
FIG. 9 is a partial perspective view of the inner form of the apparatus of the present invention with only the side walls in the retracted position.
Figure 10:
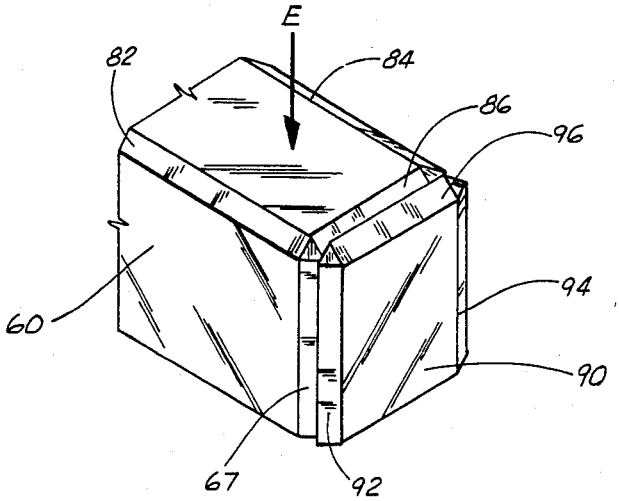
FIG. 10 is a partial perspective view of the inner form of the apparatus of the present invention with only the side walls and the upper wall in the retracted position.
Figure 11:
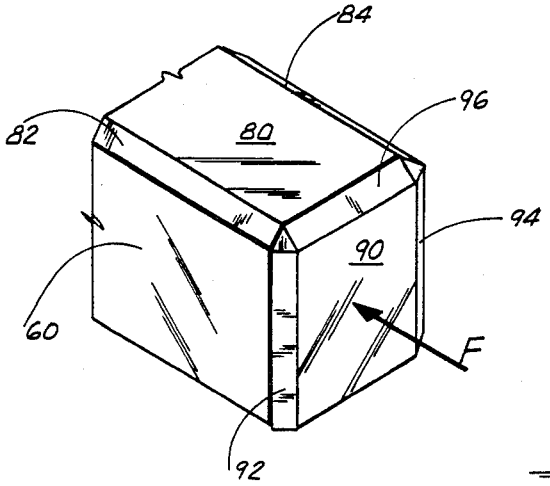
FIG. 11 is a partial perspective view of the inner form with the side walls, the upper wall, and the end wall of the inner form in the retracted position and thus the inner form in a totally retracted position.

Removal of apparatus 10 is accomplished by first providing for the collapsing of the outer mold formed by side walls 22, 24 and end wall 30 to the position of FIG. 1. Once the outer mold has been collapsed, first, as seen in FIGS. 5 and 9, inner side walls 60, 66 are retracted in the direction of ARROWS D and D' by hydraulic arms 52 with flange portions 62, 68 thus disengaging overlapping flanges 82, 84 and flange portions 67, 69 thus disengaging overlapping flange portions 92, 94. Next, as best seen in FIGS. 6 and 10, upper wall 80 is retracted or lowered in the direction of ARROW E by hydraulic arms 56 with flange portion 86 thus disengaging overlapping flange 96. Next, as best seen in FIGS. 7 and 11, end wall 90 is retracted in the direction of ARROW F by hydraulic arm(s) 58 with flange portion 96 once again overlapping flange portion 86 and flange portions 92, 94 once again overlapping flange portions 67, 69 in the retracted position of FIGS. 8–11 and 13. Thus after hydraulic arms 52, 56, 58 have retracted interior side walls 60, 66, interior upper wall 80 and interior end wall 90 from contact with the interior walls of pre-cast building unit 150, such interior walls 60, 66, 80, and 90 may be slidably removed from the interior of precast building unit 150.

To remove collapsed and retracted apparatus 10 from pre-cast building unit 150, concrete feet or support members 12 (integral with building 150) can be placed on a plurality of standard roller supports (not shown) so that apparatus 10 can be moved longitudinally away from building unit 150 by force G applied to line 120 secured or anchored to wall 158 of building unit 150, and thus base 20 will slidably detach itself from the bottom of slab 152 bringing attached side walls 22, 24 and end wall 30 along with it. Similarly, interior side walls 60, 66 interior upper wall 80 and interior end wall 90 will be removed from the interior of building unit 150 with extruder 40 as it is integrally attached to rectangular base 20 and will thus move away from building unit 150.

It can thus be appreciated that once apparatus 10 is completely removed from building unit 150, apparatus 10 can be moved to another location, reassembled to its concrete mold-forming position of FIG. 2, and concrete can be poured to form another building unit.

Pre-cast building unit 150, can now be enclosed at its one remaining open side 164 and provided with entry and access doors, window units, utilities and the like; and, unit 150 can be decorated to the end user's tastes.

Because many varying and different embodiments may be taught within the scope of the invention concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for constructing a modular, pre-cast concrete building comprising:

(a) outer and inner forms providing a mold for said building, said outer form being collapsible from its mold forming position and said inner form being retractable from its mold forming position;

(b) means for extruding said inner form from said mold;

(c) support means slidably engaging said building and said outer form for slidably supporting said building on said outer form; and (d) means attached to said building for slidably removing said building from said outer and inner forms.

2. The apparatus of claim 1 wherein said collapsible outer form further comprises a rigid base member and a plurality of rigid walls pivotally connected to said base and collapsible to the plane of said base.

3. The apparatus of claim 1 wherein said retractable inner form further comprises a plurality of rigid walls connected to said means for extruding said inner form.

4. The apparatus of claim 1 wherein said retractable inner form is hydraulically controlled.

5. An apparatus for constructing a modular pre-cast concrete building comprising:

(a) a collapsible outer form having a rigid base member and a plurality of side walls pivotally connected to said base member and collapsible to the plane of said base;

(b) a retractable inner form providing a plurality of rigid walls thereby forming with said outer form a mold for said building;

(c) means for extruding said inner form from said building mold formed by said inner form and said outer form;

(d) support members integral with said building mold;

(e) roller supports slidably engaging said support members with said outer form; and (f) means attached to said building for slidably removing said building from said inner form and said outer form.

6. The apparatus of claim 5 wherein said retractable inner form is hydraulically controlled.

7. The apparatus of claim 6 wherein said hydraulic control means is mounted on said extruding means.

8. The apparatus of claim 5 wherein said extruding means is moveable from a first position interior of said mold formed by said concrete building and to a second position removed from said concrete building.

9. The apparatus of claim 1 wherein said support means comprises:

(a) support members integral with said building; and (b) roller supports slidably engaging said support members with said outer form.

10. The apparatus of claim 1 wherein said means for slidably removing said building from said forms comprises a line secured to a wall of said building.

11. The apparatus of claim 1 wherein said building is slidably removed longitudinally away from said outer and inner forms.

12. The apparatus of claim 1 wherein said means for extruding said inner form from said mold comprises:

(a) a neck portion extending vertically from the base of said outer form;

(b) an elongated core extending perpendicular to said neck portion interior of said inner form and substantially parallel and longitudinal of the base of said outer form; and (c) a plurality of retractable arms attached at one end to said elongated core and at their opposite ends to said inner form.

13. The apparatus of claim 5 wherein said means for slidably removing said building from said inner form and said outer form comprises a line secured to a wall of said building.

14. The apparatus of claim 5 wherein said building is slidably removed longitudinally away from said inner form and said outer form.

15. The apparatus of claim 5 wherein said means for extruding said inner form from said mold comprises:

(a) a neck portion extending vertically from said base of said outer form;

(b) an elongated core extending perpendicular to said neck portion interior of said inner form and substantially parallel and longitudinal of said base of said outer form; and (c) a plurality of retractable arms attached at one end to said elongated core and at their opposite ends to said inner form.

16. An apparatus for constructing a modular pre-cast concrete building comprising:

(a) a collapsible outer form having a rigid base member and a plurality of side walls pivotally connected to said base member and collapsible to the plane of said base;

(b) a retractable inner form providing a plurality of rigid walls thereby forming with said outer form a mold for said building;

(c) means for extruding said inner form from said building mold formed by said inner form and said outer form;

(d) support members integral with said building mold;

(e) roller supports slidably engaging said support members with said outer form; and (f) means for slidably removing said building from said inner and outer forms comprising a line secured to a wall of said building.

17. The apparatus of claim 16 wherein said building is slidably removed longitudinally away from said inner form and said outer form.

18. The apparatus of claim 16 wherein said means for extruding said inner form from said mold comprises:

(a) a neck portion extending vertically from said base of said outer form;

(b) an elongated core extending perpendicular to said neck portion interior of said inner form and substantially parallel and longitudinal of said base of said outer form; and (c) a plurality of retractable arms attached at one end to said elongated core and at their opposite ends to said inner form.

* * * * *